US007568597B2

(12) United States Patent
Brogly et al.

(10) Patent No.: US 7,568,597 B2
(45) Date of Patent: Aug. 4, 2009

(54) ANTI-SEEPAGE DELIVERY SYSTEM OF A PACKAGED PRODUCT, AND PACKAGING ELEMENT COMPRISING THE SAME

(75) Inventors: Sebastien Brogly, Geovreissiat (FR); Jean-Christophe Lemerle, Oyannax (FR); Philippe Lautre, Oyonnax (FR)

(73) Assignee: Plastohm SA, Oyonnax (FR)

( * ) Notice: Subject to any disclaimer, the term of this patent is extended or adjusted under 35 U.S.C. 154(b) by 534 days.

(21) Appl. No.: 11/440,684

(22) Filed: May 24, 2006

(65) Prior Publication Data

US 2007/0251958 A1 Nov. 1, 2007

(30) Foreign Application Priority Data

Apr. 26, 2006 (FR) ..... 06 04004
May 19, 2006 (FR) ..... 06 04505

(51) Int. Cl.
*B65D 5/72* (2006.01)

(52) U.S. Cl. ..... 222/491; 222/212; 222/213; 222/494; 222/519; 222/520; 222/548

(58) Field of Classification Search ..... 222/491, 222/494, 495, 519, 520, 525, 212–213, 516, 222/549, 548
See application file for complete search history.

(56) References Cited

U.S. PATENT DOCUMENTS 2,750,084 A * 6/1956 Moran ..... 222/490
3,200,995 A * 8/1965 Gangwisch ..... 222/94
3,876,118 A * 4/1975 Loredo ..... 222/212
5,325,999 A * 7/1994 Gueret ..... 222/212
6,398,077 B1 * 6/2002 Gross et al. ..... 222/145.1

* cited by examiner

*Primary Examiner*—Frederick C. Nicolas
(74) *Attorney, Agent, or Firm*—Bachman & LaPointe, P.C.

(57) ABSTRACT

A system of delivering a liquid to pasty product is designed to be installed on a flexible tube on which the user acts by manual pressure to cause the product to come out. The system has a base element that is attached to the open end of the tube, a window associated with a strip that can be moved in opening, and a cap designed to cover the base element having opposite the strip an integral recess capable of allowing the deflection in opening of the strip.

19 Claims, 6 Drawing Sheets

ANTI-SEEPAGE DELIVERY SYSTEM OF A PACKAGED PRODUCT, AND PACKAGING ELEMENT COMPRISING THE SAME

BACKGROUND OF THE INVENTION (1) Field of the Invention

The present invention relates to a delivery system designed to be able to be placed on a packaging element of the flexible tube, small bottle or equivalent type.

(2) Prior Art

Such a delivery element must make it possible to deliver a more or less viscous product of the cream, paste, milk or equivalent type.

In this type of packaging element, the product is extracted from it by manual pressure on the latter, after it has been opened, and then closed after use.

A major disadvantage is well known in the use of this type of tube and consists in that there is a seepage of the product at the outlet of the tube, even after the user has ceased exerting pressure on the tube.

The result of this is an impression of mess which adds to the fact that the user may dirty himself or else dirty the place in which the tube is stored.

Finally, the product may come out unintentionally in fits and starts when it is opened due to a preliminary unintentional pressure on the tube.

It is known practice to resolve this type of problem with systems of silicone anti-return valves requiring a pressure on the content to let the product come out. However, these systems have a considerable number of parts and the seepage is only limited.

In addition, their production in small diameters is difficult to achieve, all the more so since the seepage problem exists essentially on small diameter outlets.

SUMMARY OF THE INVENTION

The object of the present invention is to remedy these disadvantages and, as a result, relates to a system of delivering a liquid to pasty product, designed to be installed at the open end of a packaging element, of the flexible tube or small bottle type, on which the user acts by manual pressure to cause the product to come out via integrated opening/closing means, characterized in that it comprises:

- a base element formed by a hollow body that is attached at the open end of the tube and comprises a window associated with a strip, of substantially matching shape and dimensions, that can be moved in opening under the effect of pressure of the product, during a pressing action on the tube, to be returned automatically to its initial closed position when the pressure ceases or diminishes,
- a cap designed to cover the base element at least in its top part comprising the window and the strip, and comprising an internal recess opposite the latter, of dimensions at least matching those of the strip and of such a depth as to allow the deflection in opening of the latter and consequently the receipt of the product from said recess, then its routing toward an outlet hole made in a top zone of the cap, the immobilization in closure of the strip being obtained by moving the cap, until the recess is no longer opposite the latter.

The window associated with the strip is made on the periphery of the hollow body of the base element, or on its top plane.

The invention also relates to the features that will emerge during the following description, features that should be considered in isolation or in all their possible technical combinations.

BRIEF DESCRIPTION OF THE DRAWINGS

This description, given as a nonlimiting example, will make it easier to understand how the invention can be embodied with reference to the appended drawings in which.

DETAILED DESCRIPTION OF THE PREFERRED EMBODIMENT(S)

Figure 2:
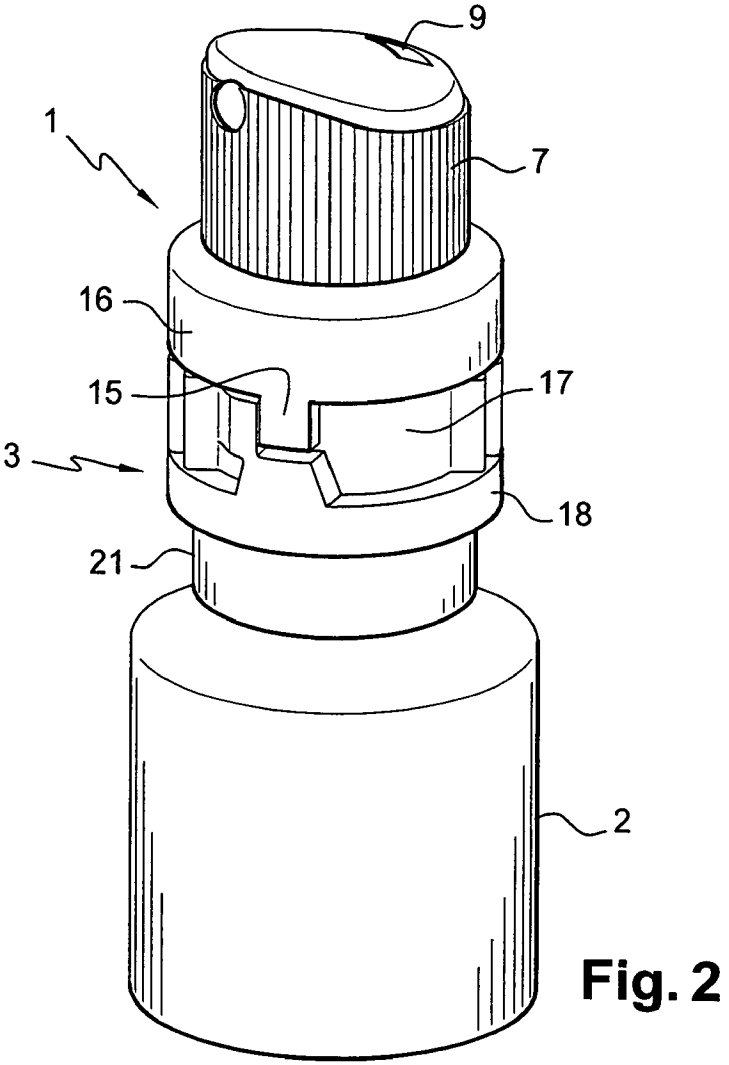
FIG. 2 represents in perspective a complete delivery system, according to the invention, placed on the end of a tube, comprising a locking ring.
Figure 1:
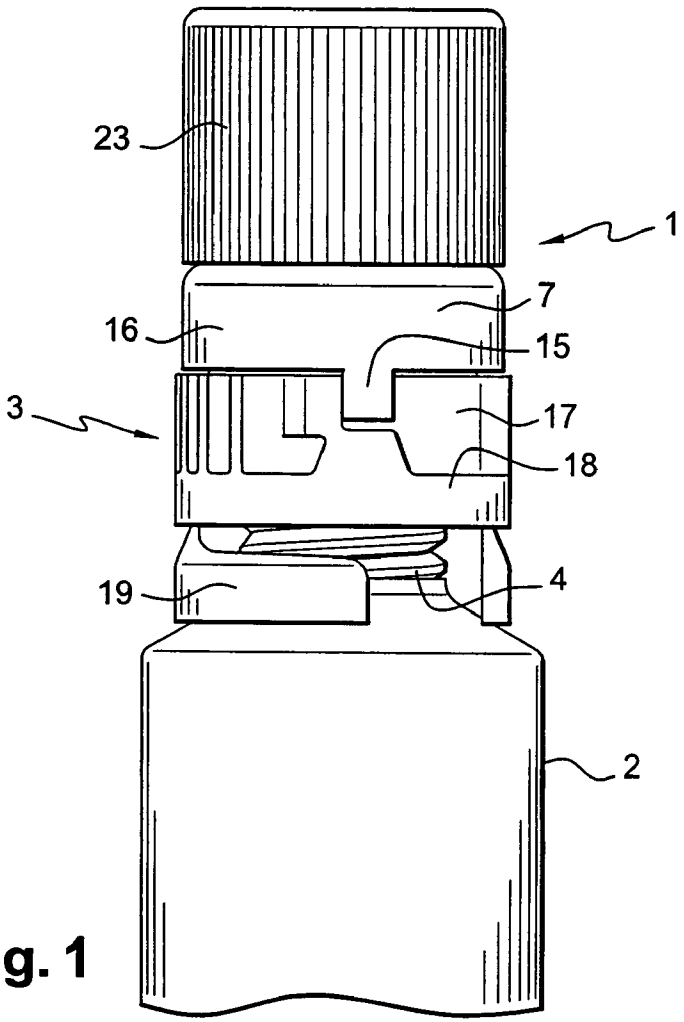
FIG. 1 represents in plan view a complete delivery system, according to the invention, placed on the end of a tube, comprising an anti-tamper band.

The system 1 indicated globally in all the figures is designed to be installed at the open end of a packaging element 2, of the flexible tube or small bottle type, on which the user acts by manual pressure to cause a liquid or pasty product to come out via integrated opening/closure means.

According to the invention, it comprises a base element 3 formed by a hollow body that is attached at the open end 4 of the tube 2 and comprises, on its periphery or its top plane, a window 5A, 5B associated with a strip 6A, 6B, of substantially matching shape and dimensions, that can be moved in opening under the effect of pressure of the product, during a pressing action on the tube 2, to be returned automatically to its initial closed position when the pressure ceases or diminishes.

This strip is positioned so as to come to block off the window situated in the thickness of the base so that the strip in position is integrated and does not protrude from the thickness of the base element. When the strip is in its window, it completely blocks off the window in a sealed manner and prevents any passage of the product.

Under the pressing action of the user on the tube, and therefore of the product inside the hollow body, the strip moves outward under the pressure.

The system also comprises a cap 7 designed to cover the base element 3A, 3B at least in its top part comprising the window 5A, 5B and the strip 6A, 6B, and comprising an internal recess 8 opposite the latter, of dimensions at least matching those of the strip 6A, 6B and of such a depth as to allow the deflection in opening of the latter and consequently the receipt of the product from said recess 8, then its routing toward an outlet hole 9 made in a top zone of the cap 7, the immobilization in closure of the strip 6A, 6B being obtained by moving the cap 7, until the recess 8 is no longer opposite the latter.

This is how the strip, by its positioning in the housing, makes it possible to cut off the flow of product and prevent an undesired seepage of the latter, even when the recess is opposite the strip.

Figure 4:
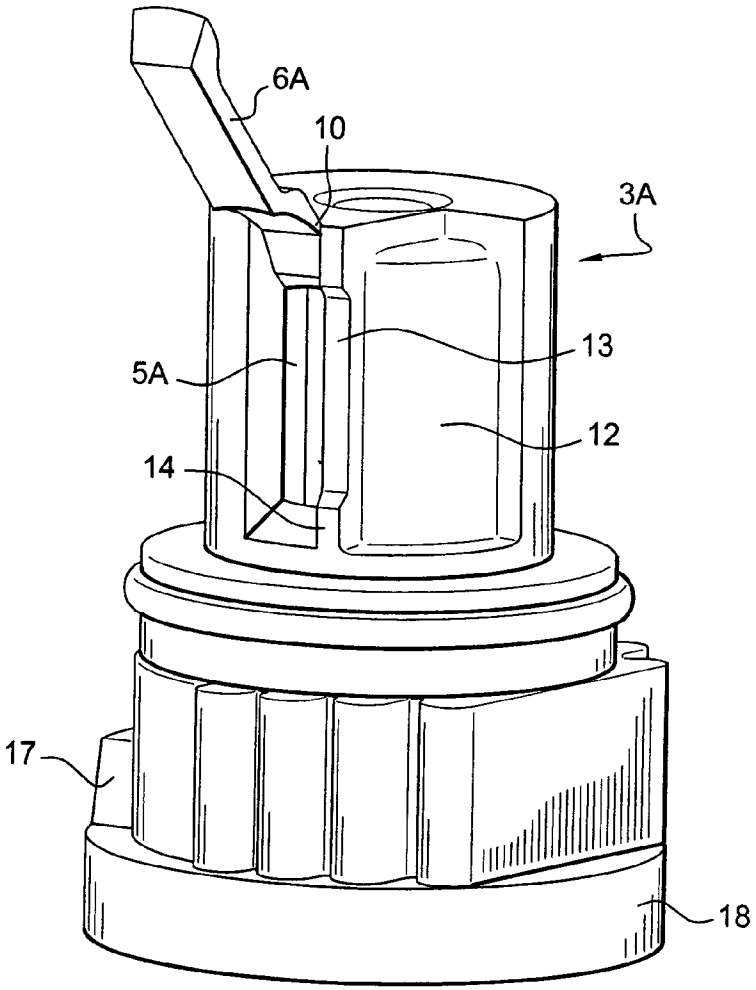
FIG. 4 represents, in perspective and on an enlarged scale, the base element of the system, according to a first exemplary embodiment using a vertical deflection strip, before the latter is positioned in the window.
Figure 3:
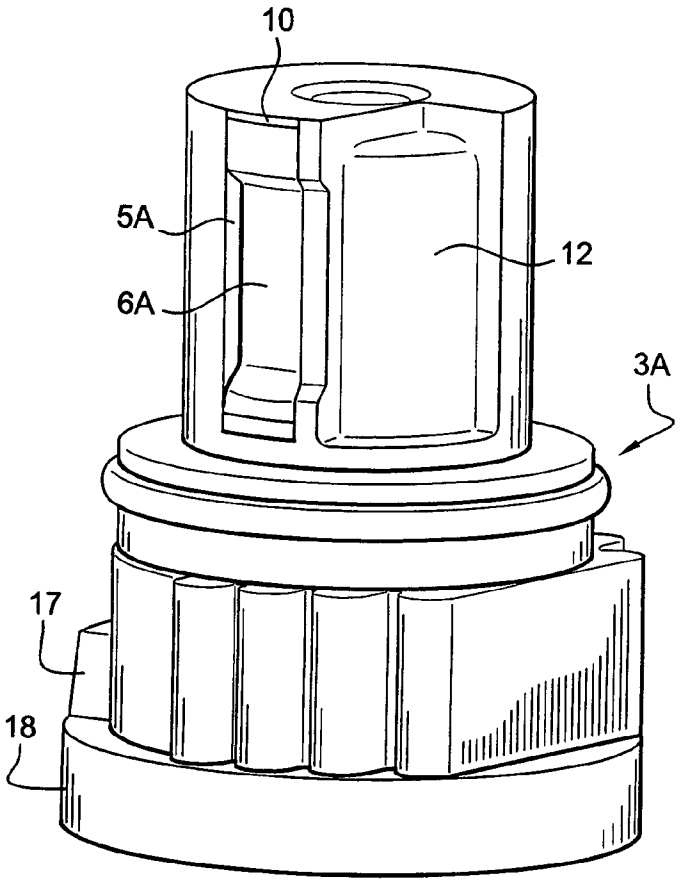
FIG. 3 represents, in perspective and on an enlarged scale, the base element of the system, according to a first exemplary embodiment using a vertical deflection strip, in the closed position.

According to a first exemplary embodiment of the strip, represented in FIGS. 3 and 4, the window 5A of the base 3A being rectangular, the movable strip 6A blocking it off in closure is fixedly attached to a top right side 10 of said window 5A by means of an articulation, the recess 8 of the cap 7 being made over the whole height of the strip 6A in order to allow the angular deflection in opening of the latter, along a vertical plane.

The strip therefore rotates about an axis of rotation, in which case the pressure merely lifts the strip and the latter repositions itself when a reverse flow is initiated, said flow pulling the strip.

According to a variant embodiment not shown, the window 5A of the base 3A being rectangular, the movable strip 6A blocking it off in closure originates directly from a top right side 10 of said window, in order to render it elastically deformable for an angular deflection in opening, along a vertical plane.

In this case, the recess 8 of the cap 7 does not need to be made over the whole height of the strip.

The strip is here prevented from rotating, in which case the strip deforms elastically under the action of the pressure and repositions itself automatically when the pressure diminishes.

Figure 6:
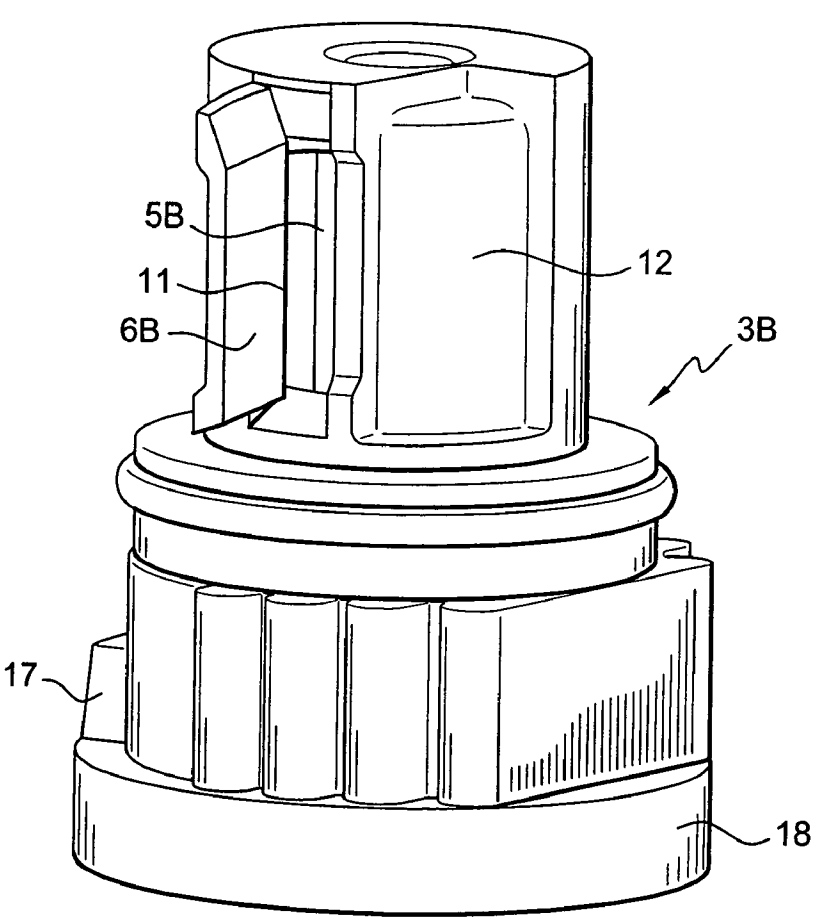
FIG. 6 represents, in perspective and on an enlarged scale, the base element of the system, according to a first exemplary embodiment using a horizontal deflection strip, before the latter is positioned in the window.
Figure 5:
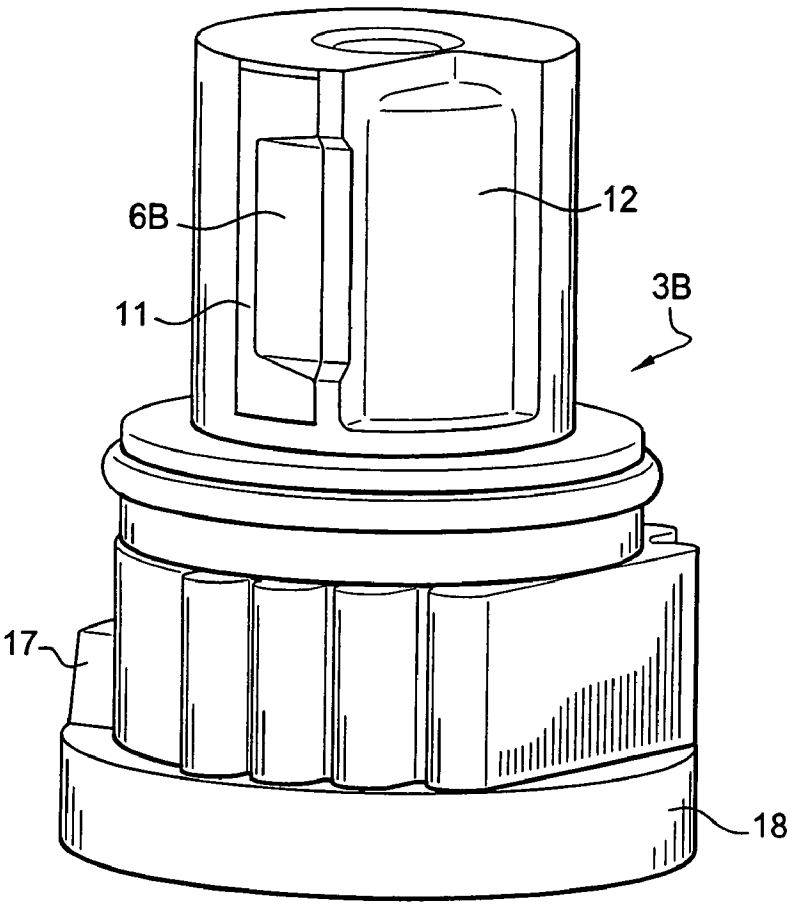
FIG. 5 represents, in perspective and on an enlarged scale, the base element of the system, according to a first exemplary embodiment using a horizontal deflection strip, in the closed position.
Figure 7:
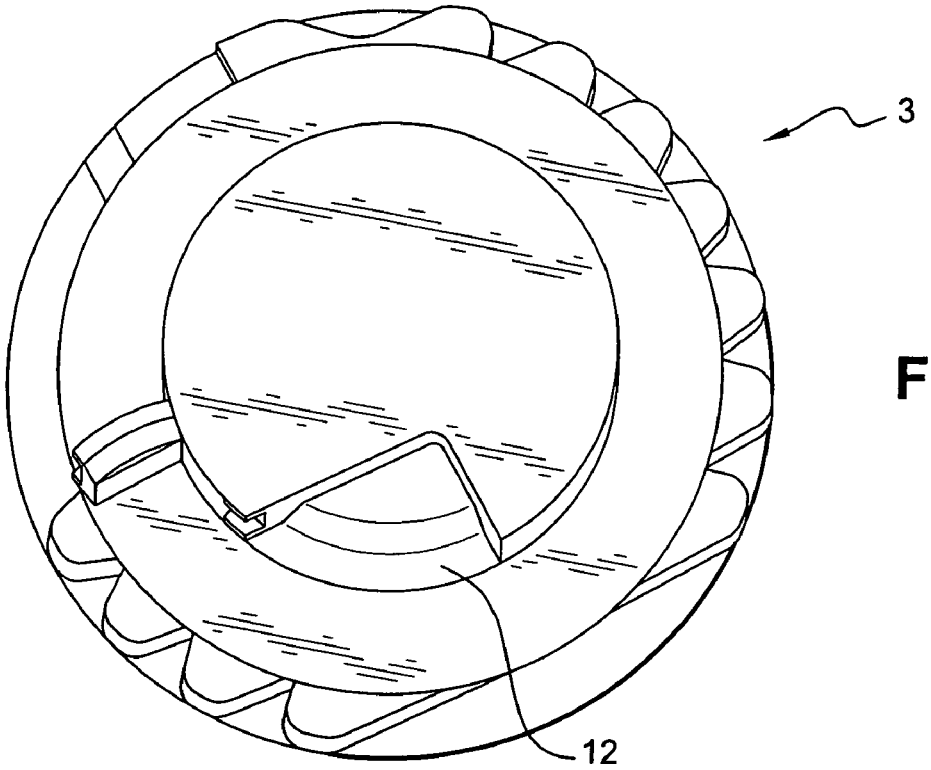
FIG. 7 is a top view, in plan view, of a base element according to FIG. 6.
Figure 8:
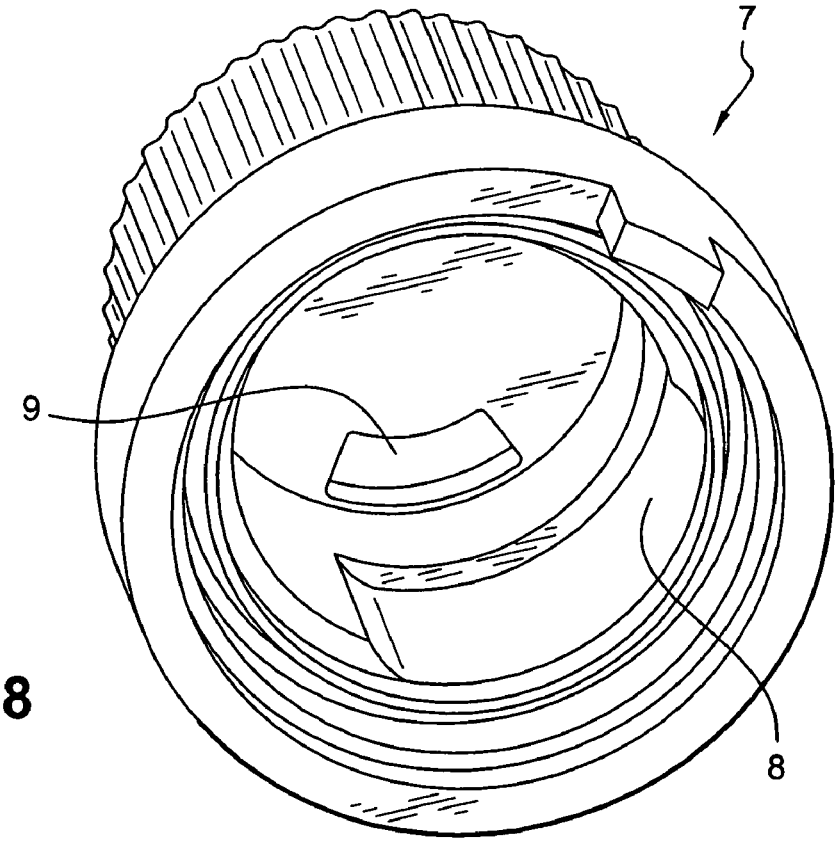
FIG. 8 is a view in perspective of a cap interacting with a base element, according to the preceding figures.
Figure 9:
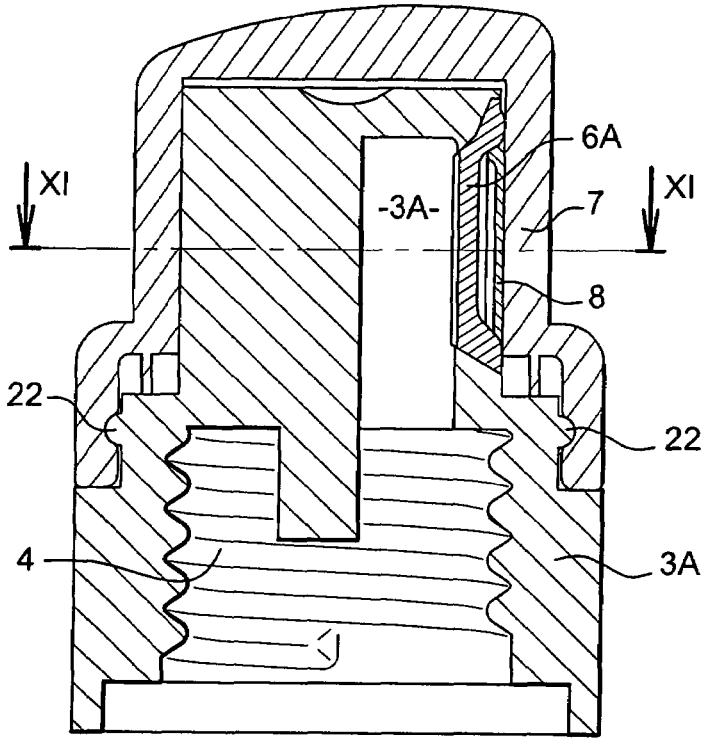
FIGS. 9 and 10 are views in longitudinal section, according to the exemplary embodiment of FIGS. 3 and 4, using a vertical strip, respectively in the closed and open position.
Figure 10:
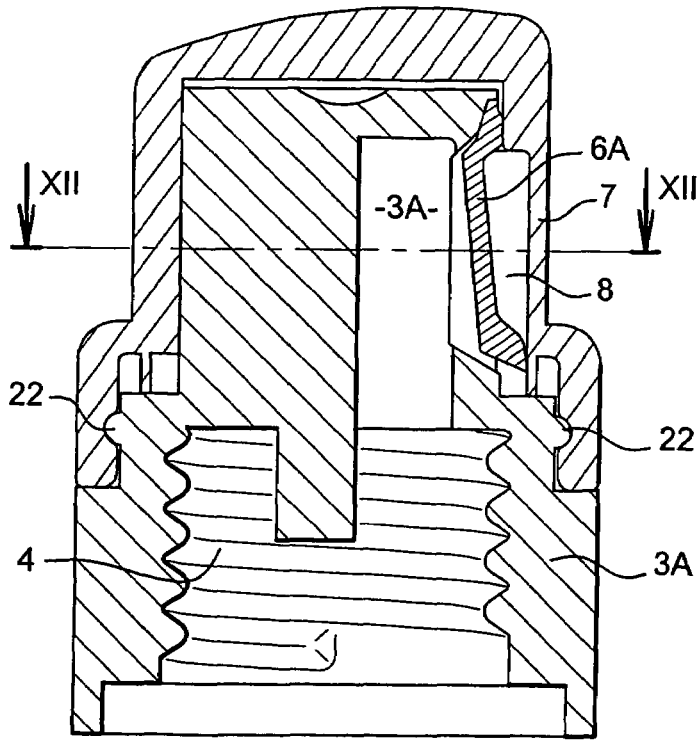
Figure 11:
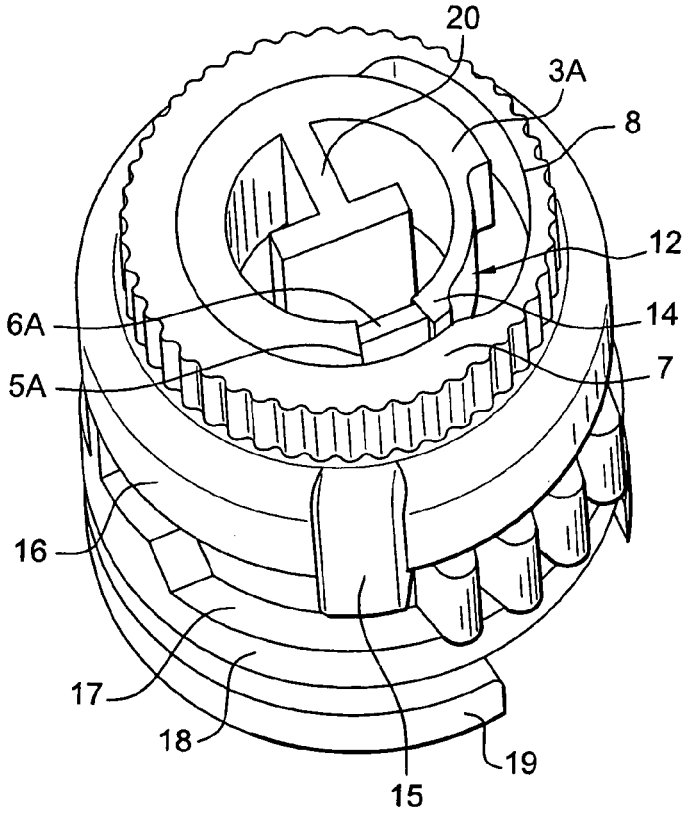
FIGS. 11 and 12 are respectively views in section along the lines XI-XI and XII-XII of FIGS. 9 and 10.
Figure 12:
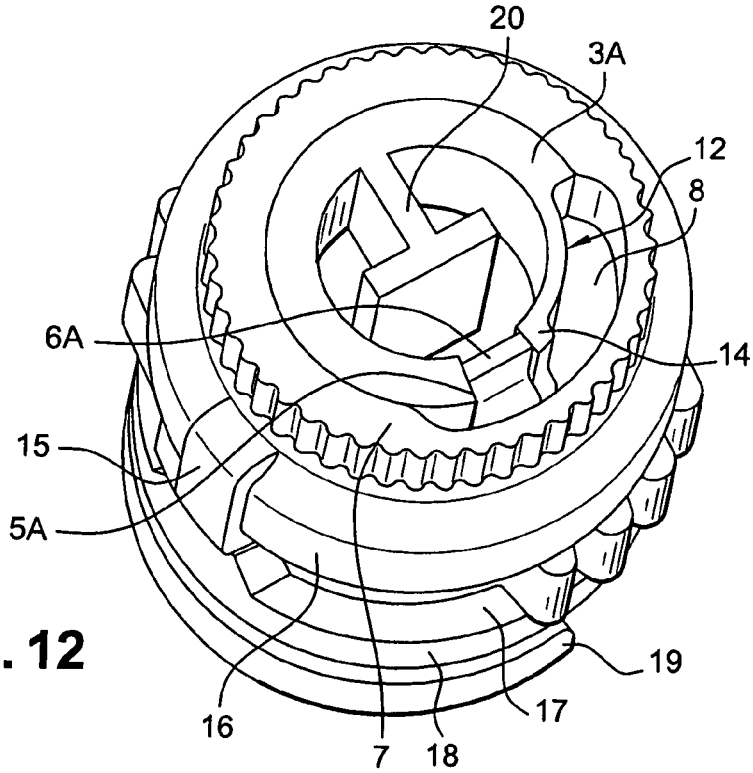

According to the second embodiment represented in FIGS. 5 and 6, the window 5B of the base 3B being rectangular, the movable strip 6B blocking it off in closure is fixedly attached to one of the lateral sides 11 of said window 5B by means of an articulation, the recess 8 of the cap 7 being made over the whole width of the strip 6B in order to allow the angular deflection of the strip 6B in opening, along a horizontal plane.

According to a variant not shown of the embodiment that has just been described, the window 5B of the base 3B being rectangular, the movable strip 6B blocking it off in closure originates directly from one of the lateral sides of said window 5B, in order to render it elastically deformable for an angular deflection in opening, along a horizontal plane.

In this case, as hereinabove, there is no need to make the recess 8 of the cap 7 over the whole width of the strip 6B.

According to another feature of the invention, the base element 3A, 3B comprises a transit chamber 12 for the product, made close to the window 5A, 5B with which it communicates via a chicane 13 made on a separating rib 14, a chamber also in communication with an outlet hole 9 made on the top part of the cap 7, in line with the internal recess 8 of the latter, whose height is substantially equal to that of the window 5A, 5B and whose width substantially equal to the sum of the width of the same window 5A, 5B and of the width of the transit chamber 12.

The transit chamber 12 and the chicane 13 are essentially intended to achieve a less violent emergence of the product, because it is less direct, due to losses of pressure.

It should be noted that provision could also be made to produce an outlet hole from the cap on the side of the latter rather than on the top as mentioned hereinabove.

According to the exemplary embodiments represented in the figures, the relative position of the cap 7, and more particularly of its internal recess 8, relative to the base element 3, and more particularly of the window 5A, 5B furnished with the strip 6A, 6B and of the adjacent transit chamber 12, is obtained by rotating the cap 7 on the base element 3 to obtain either an opening of the strip 6A, 6B or an emergence of the product through the hole 9 of the cap 7, via the internal recess 8 of the cap 7 and of the transit chamber 12 of the base 3, when these parts are opposite one another, or a closure when they are not.

Naturally, according to another variant embodiment (not shown) of the closure means, it would be possible to imagine a "push-pull" system, that is to say a system that does not rotate but makes a linear movement upward or downward.

Furthermore, the cap 7 and the base element 3A, 3B comprise matching indexation means consisting respectively of a finger 15 originating from the outer periphery of a bottom collar 16 of the cap 7, capable of deflecting in rotation into a matching indentation 17, made on the outer periphery of a top collar 18 of the base element 3, the maximum positions of the finger 15 in the indentation 17 corresponding to an opening or a closure.

According to a variant embodiment, the cap 7 and the base element 3A, 3B comprise matching indexation means consisting of arrows placed on said cap and said base element, to be placed opposite one another, depending on whether the user wishes to obtain an opening or a closure of the system.

The base element 3A, 3B comprises, in an inner central zone, a perforating element 20 designed to pierce a lid of the tube 2.

Equally, the base element 3A, 3B comprises, on its bottom periphery, a tear-off anti-tamper band 19 connected with the neck 4 of the tube 2.

According to a variant embodiment that can be seen in FIG. 2, a locking ring 21 is interposed between the base element 3A, 3B and the tube 2 in order to prevent any attempt at piercing by screwing.

The base element 3 can be screwed or snapped onto the tube 2.

As concerns the cap 7, it is clipped 22 onto the base element 3.

The base element 3A, 3B, furnished with its cap 7 which is fixedly attached thereto, is protected by a removable top 23.

Finally, with respect to the base element 3, the cap 7 or the top 23, these constituent elements are obtained individually by molding a plastic material.

The invention also relates to a packaging element, flexible tube or small bottle, comprising a delivery system as described hereinabove.

The invention claimed is:

1. System of delivering a liquid to a pasty product, designed to be installed at an open end of a packaging element constituted by one of a flexible tube and a small bottom on which a user acts by manual pressure to cause the product to come out via integrated opening/closing means, wherein the system comprises:

a base element formed by a hollow body that is attached at an open end of a tube and comprises a window associated with a movable strip of substantially matching shape and dimensions that can be moved in opening by pressure of the product, during a pressing action on the tube, to be returned automatically to an initial closed position when the pressure ceases or diminishes, and a cap designed to cover the base element at least in a top part comprising the window and the strip, and comprising an internal recess opposite the strip, of dimensions at least matching those of the strip and of such a depth as to allow a deflection in opening of the strip and consequently a receipt of the product in said recess, then its routing toward an outlet hole made in a top zone of the cap.

2. A delivery system according to claim 1, wherein the window associated with the strip is made on a periphery of a hollow body of the base element.

3. A delivery system according to claim 1, wherein the window associated with the strip is made on a top plane of a hollow body of the base element.

4. A delivery system according to claim 1, wherein the strip is locked in closure by moving the cap until the recess is no longer opposite the cap.

5. A delivery system according to claim 1, wherein the window of the base element is rectangular, the movable strip blocking the window off in closure is fixedly attached to a top side of said window by means of an articulation, the recess of the cap is made over a whole height of the strip in order to allow an angular deflection in opening of the strip, along a vertical plane.

6. A delivery system according to claim 1, wherein the window of the base element is rectangular, the movable strip blocking the window off in closure originates directly from a top side of said window, in order to render it elastically deformable for an angular deflection in opening, along a vertical plane.

7. A delivery system according to claim 1, wherein the window of the base element is rectangular, the movable strip blocking the window off in closure is fixedly attached to one lateral side of said window by means of an articulation, the recess of the cap is made over a whole width of a strip in order to allow an angular deflection of the strip in opening, along a horizontal plane.

8. A delivery system according to claim 1, wherein the window of the base element is rectangular, the movable strip blocking the window off in closure originates directly from one lateral side of said window, in order to render it elastically deformable for an angular deflection in opening, along a horizontal plane.

9. A delivery system according to claim 1, wherein the base element comprises a transit chamber for the product, made close to the window with which it communicates via a chicane made on a separating rib, a chamber also in communication with an outlet hole made on a top part of the cap, in line with an internal recess of the cap, whose height is substantially equal to that of the window and whose width is substantially equal to a sum of the width of the same window and the width of the transit chamber.

10. A delivery system according to claim 9, wherein the cap and the base element comprise matching indexation means consisting respectively of a finger originating from an outer periphery of a bottom collar of the cap, capable of deflecting in rotation into a matching indentation, made on an outer periphery of a top collar of the base element, and maximum positions of the finger in the indentation corresponding to an opening or a closure.

11. A delivery system according to claim 9, wherein the cap and the base element comprise matching indexation means consisting of arrows placed on said cap and said base element, to be placed opposite one another, depending on whether a user wishes to obtain an opening or a closure of the system.

12. A delivery system according to claim 1, wherein the base element comprises, in an inner central zone, a perforating element designed to pierce a lid of the tube.

13. A delivery system according to claim 1, wherein the base element comprises, on its bottom periphery, a tear-off anti-tamper band connected with a neck of the tube.

14. A delivery system according to claim 1, wherein a locking ring is interposed between the base element and the tube in order to prevent any attempt at piercing by screwing.

15. A delivery system according to claim 1, wherein the base element is screwed onto the tube.

16. A delivery system according to claim 1, wherein the base element is snapped onto the tube.

17. A delivery system according to claim 1, wherein the cap is clipped onto the base element.

18. A delivery system according to claim 1, wherein the base element, furnished with the cap which is fixedly attached thereto, is protected by a removable top.

19. A packaging element which comprises an anti-seepage delivery system according to claim 1.

* * * * *